United States Patent [19]

Wanner et al.

[11] 4,133,990

[45] Jan. 9, 1979

[54] ROTARY SWITCH

[75] Inventors: Vernon W. Wanner, Milwaukee, Wis.; Richard W. Germuska, Brunswick, Ohio

[73] Assignee: Globe-Union Inc., Milwaukee, Wis.

[21] Appl. No.: 810,060

[22] Filed: Jun. 27, 1977

[51] Int. Cl.[2] ..... H01H 19/60

[52] U.S. Cl. ..... 200/6 B; 200/6 BB; 200/11 R; 200/14; 200/17 R; 200/153 L; 200/303; 200/307

[58] Field of Search ..... 200/6 R, 6 CB, 6 BA, 200/6 BB, 6 C, 11 TW, 14, 153 L, 153 LB, 11 R, 1 R, 11 DA, 115, 17, 18, 307, 303

[56] References Cited

U.S. PATENT DOCUMENTS

| | | | |
|---|---|---|---|
| 3,053,947 | 9/1962 | Bowman et al. | 200/153 LX |
| 3,198,893 | 8/1965 | Mapelsden | 200/153 L X |
| 3,324,267 | 6/1967 | Edelson | 200/153 LB |
| 3,723,674 | 3/1973 | Khitro et al. | 200/6 BB X |
| 3,754,106 | 8/1973 | MacDonald | 200/17 R X |
| 4,070,555 | 1/1978 | Carli | 200/6 B |
| 4,071,720 | 1/1978 | Krajci et al. | 200/6 B |

*Primary Examiner*—James H. Scott
*Attorney, Agent, or Firm*—John Phillip Ryan

[57] ABSTRACT

A rotary switch for use with electrical circuits and including a housing having a cavity therein for receiving a rotatable disc. The housing supports a plurality of spaced apart electrical terminals each independently connected to an electric circuit and also supports a plurality of opposed resilient contacts selectively engagable with the electrical terminals. The rotor includes opposed planar surfaces, one of the surfaces parallel to and adjacent the resilient contacts, the rotor surface supporting a plurality of cams projecting from the surface and functional upon rotation of the rotor to force selected ones of the resilient contacts into engagement with the terminals to provide an electrical bridge between pairs of the electrical terminals. The rotary switch rotor can include cam members on both of its opposite surfaces and the housings are constructed such that they can be stacked.

7 Claims, 14 Drawing Figures

ROTARY SWITCH

BACKGROUND OF THE INVENTION

1. Field of the Invention

The present invention relates to rotary switches of the type used in electric apparatus and more particularly relates to an improved rotary switch having a rotatable disc supporting projecting cam lobes, the cam lobes being functional upon rotation of the disc to force selected electrically conductive spring contact fingers into engagement with opposed electrical terminals, the contact of the fingers and the terminals closing an electric circuit.

2. DESCRIPTION OF THE PRIOR ART

Prior art rotary switches of a type in common use are illustrated in U.S. Pat. Nos. 2,949,511 issued Aug. 16, 1960 to Glueckstein et al; 3,213,212 issued Oct. 19, 1965 to Sefton; 3,242,271 issued Mar. 22, 1966 to Stephan et al; 3,248,488 issued Apr. 26, 1966 to Stephan; and 3,308,248 issued Mar. 7, 1967 to Stephan et al. Switches of the type illustrated in the above mentioned patents are characteristic in that they are reliable and durable. However, they are subject to the disadvantage that they usually include a large number of circumferentially spaced clips individually secured around the circumference of a circular disc and a number of circumferentially spaced eyelets similarly individually secured around a circular disc. Due to the relatively large number of components comprising these switches, positioning and securing each of the components during manufacturing can be time consuming, effort intensive and costly.

More recently developed rotary switches endeavor to avoid these high production costs, but these switches prove to be unsatisfactory in other ways. Such rotary switches are shown, for example, by U.S. Pat. Nos. 3,736,390 issued May 29, 1973 to Lockard; and 3,999,021 issued Dec. 21, 1976 to Delp. These switches include a molded housing having a plurality of spaced apart side-by-side contacts supported therein and a rotatable disc supported in the housing adjacent the contacts such that the contacts are received against a planar side surface of the rotatable disc. The planar surface of the disc supports metalized electrode path patterns thereon such that rotation of the disc will result in the printed circuits providing an electrically conductive bridge between selected pairs of the contacts. A decided disadvantage of such structures is that the friction of the contacts against the electrode paths during rotation of the rotor tends to cause the metalized electrode paths to migrate in the direction of movement of the contacts as the disc rotates, eventually causing shorting between the electrode paths and resultant failure of the rotary switch.

Another structure employing a rotatable disc functional to cause an electrical connection in response to rotation of the disc is shown in U.S. Pat. No. 3,813,668 issued May 28, 1974 to Ross. The Ross patent shows a push button switch wherein a push button assembly is engageable against lugs projecting from one planar surface of a rotatable disc to cause rotation of the disc. The opposite side of the disc includes a plurality of grooves each for receiving a projecting shoulder of a metallic sensing member. The grooves each include deep cut portions and shallow-cut portions whereby rotation of the disc causes movement of the sensing members into electrical contact with a common terminal. The structure of the Ross patent is inadequate for use in connection with a rotary switch since the housing and rotor structure as well as the common terminal and sensing member arrangement facilitates only a relatively small number of switching positions, since it comprises an unduly large package, and since it is not capable of being stacked together with other similar switches.

SUMMARY OF THE INVENTION

The present invention provides a rotary switch which overcomes each of the disadvantages of the prior art structures referred to above and comprises a durable and reliable device which can be readily manufactured.

The rotary switch generally includes a deck comprised of a pair of separable housings, the housings defining a cavity therebetween for receiving a central rotatable disc or rotor. At least one of the housings supports a plurality of spaced apart electrical terminals which are connectable to an electrical circuit and further supports a plurality of resilient electrically conductive contact fingers. The contact fingers are electrically connected and each contact finger is positioned adjacent to but spaced from one of the terminals. The contact fingers are also electrically connectable to the circuit and are resilient such that each of the contacts can be forced into engagement with one of the terminals. The rotor includes a planar surface parallel to the contact fingers and the terminals, and the planar surface supports a plurality of cam lobes whereby rotation of the rotor causes the cam lobes to contact at least one of the contact fingers, forcing the end of that contact finger into engagement with an opposed terminal thereby closing a circuit.

The deck may be constructed such that both of the housings support terminals and opposed contact fingers. In such an embodiment, both of the opposed planar sides of the rotor disc support cam lobes thereon for forcing the contact fingers of each of these housings into engagement with opposed terminals. The housings may also be constructed such that they are identical and can be assembled in a stacked back-to-back relationship whereby a plurality of the rotary switch decks can be stacked together with the rotors in axial alignment and journaled together such that rotation of one of the rotors will result in operation of each of these stacked rotary switch decks.

The rotary switch of the invention is a substantial improvement over the prior art clip and contact type switches because it is constructed from a substantially smaller number of component parts and is more easily assembled. A further advantage of the rotary switch of the invention is that it does not employ the printed circuit patterns of the printed circuit disc type rotary switches and as a result it is not subject to failure due to migration of the electrode material and consequent shorting of the switch.

Another substantial advantage of the invention is that the engagement of the contact fingers and the terminals results in a sliding engagement of the contact finger against the terminal, resulting in a self-cleaning contact between the contact finger and the terminal thereby maintaining low and stable contact resistance during closure and prolonging the mechanical life of the switch. Furthermore fabrication of the spring contact member from metal strips allows use of precious metal only in the areas of engagement between the spring and the terminal permitting optimum design from cost, wear, and electrical resistance considerations.

An additional advantage of the invention is that the rotary switch housing is designed to readily receive the housing of an indexing unit to facilitate stacking of the indexing unit and switch housing to form a compact convenient unit.

Another advantage of the rotary switch is that extended mechanical life of the switch is achieved because the contact fingers engage the rotor only when electrical connection is made so that rotation of the rotor does not result in substantial wear of the contact fingers. Furthermore, except when electrical contact is made between the contact fingers and the terminals, an air gap exists therebetween providing high insulation resistance.

A further advantage of the rotary switch is that it provides a high degree of flexibility of contact programming by varying the relative number or position of the cam lobes or varying the number of terminals or contacts. For example, the switch could easily include two common terminals without substantial modification.

While the invention will be described in connection with a preferred embodiment, the invention is not limited to that embodiment but includes all other alternatives, modifications and equivalents as may be included within the spirit and scope of the invention as defined by the claims.

DESCRIPTION OF THE PREFERRED EMBODIMENT

Figure 1:
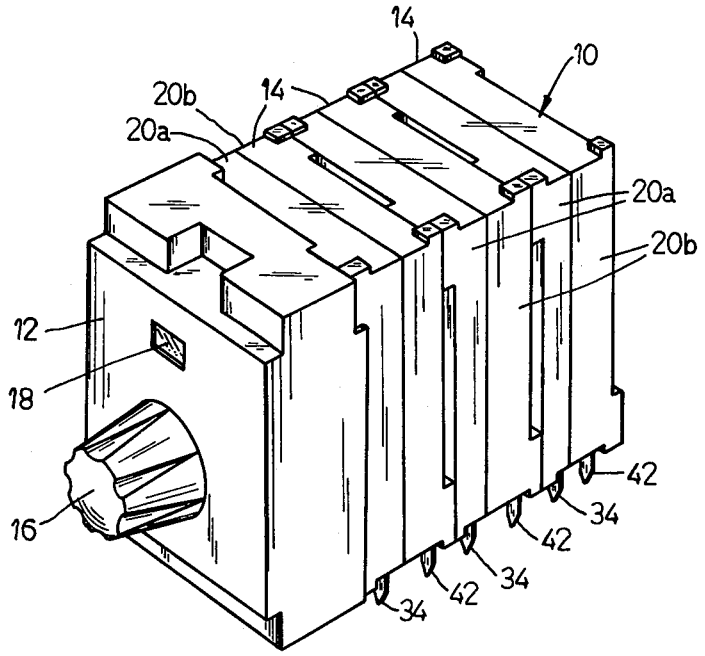
FIG. 1 is a perspective view of a rotary switch assembly including an indexing unit and a plurality of rotary switch decks in stacked arrangement.

A rotary switch assembly 10 is shown in FIG. 1 as being comprised of an indexing unit 12 and three stacked rotary switch decks 14. The indexing unit 12 is of a type well known to those skilled in the art and is shown merely as an example of an indexing unit which could be used with the rotary switch of the invention. The indexing unit 12 includes a rotatable knob 16 and a central shaft (not shown) and also includes a window 18 for displaying indicia of the relative position of the indexing unit and rotary switch.

Figure 2:
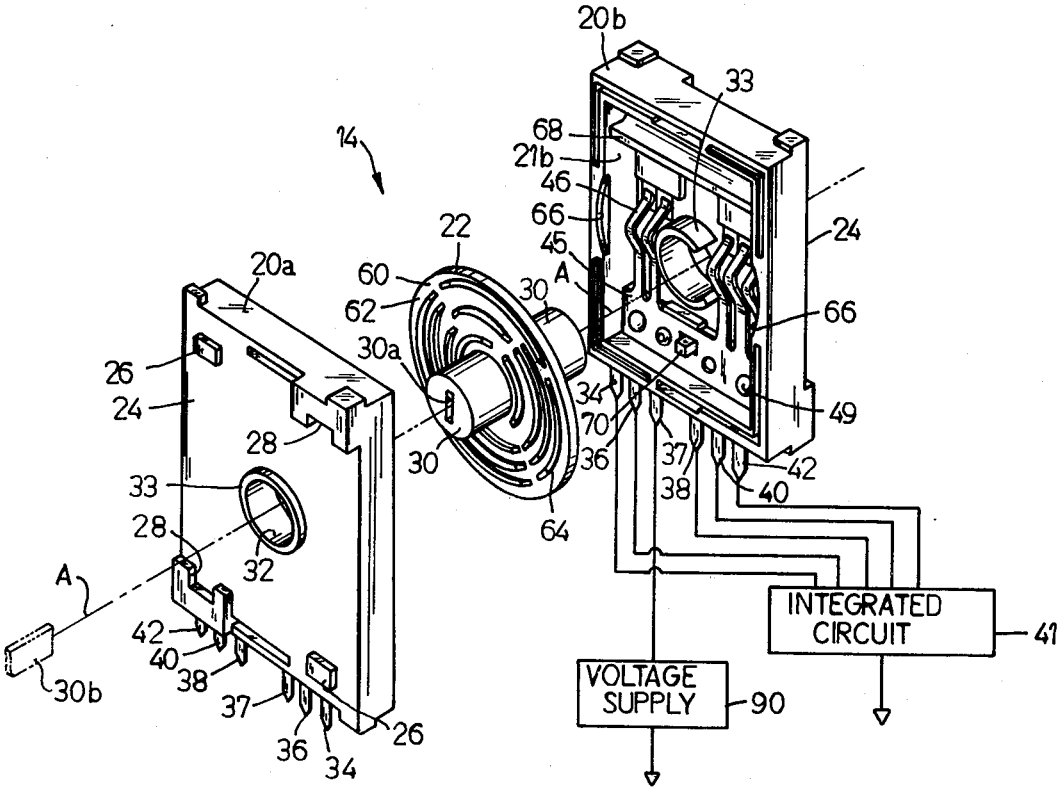
FIG. 2 is an exploded perspective view of one of the rotary switch decks shown in FIG. 1.
Figure 6:
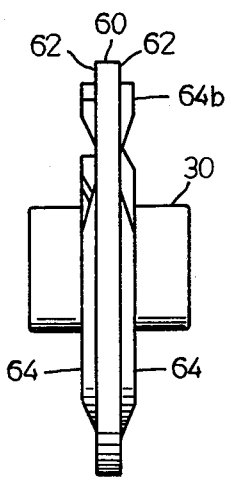
FIG. 6 is a side elevation view of the rotor shown in FIGS. 3 and 5.

One of the rotary switch decks 14 is shown in an exploded perspective view in FIG. 2 as being generally comprised of a pair of identical housings 20*a* and 20*b* each defining a central rectangular cavity 21*a* and 21*b* therein, respectively, and supporting a rotatable disc or rotor 22 within the opposed cavities 21*a* and 21*b*. The housings 20*a* and 20*b* are preferably constructed from molded plastic material and each include an external face 24 having a configuration such that the housings may be easily assembled in stacked interlocking relationship as shown in FIG. 1. To facilitate such stacking, the external vertical face 24 of each housing is provided with a pair of projecting lugs 26 at diagonally opposed corners of the face 24, the lugs 26 being receivable within complementary notches 28 of an adjacent switch housing. Though FIG. 1 illustrates three rotary switch decks 14 assembled in stacked relationship, it should be readily apparent to one skilled in the art that any number of decks 14 can be used together depending on their intended purpose.

Figure 5:
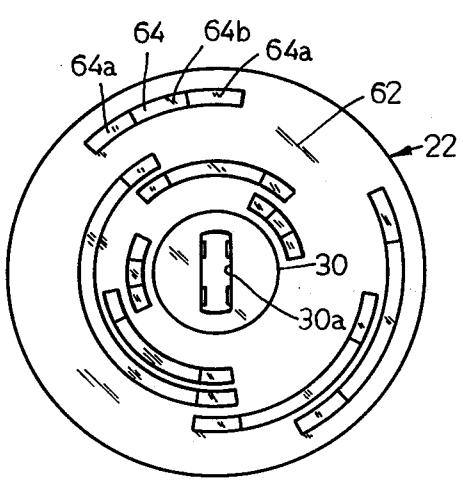
FIG. 5 is an elevation view of the rotor shown in FIG. 3 and showing the disc surface opposite that shown in FIG. 3.
Figure 4:
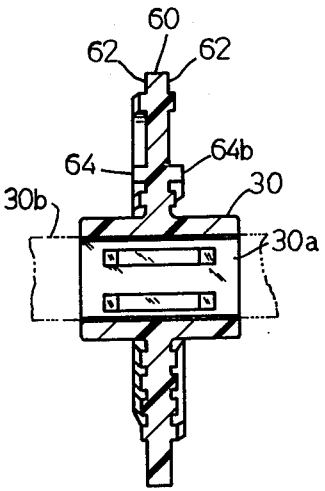
FIG. 4 is a cross-section view taken along line 4—4 in FIG. 3.
Figure 3:
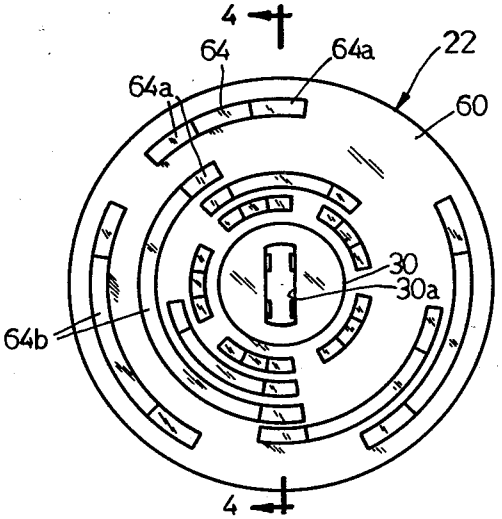
FIG. 3 is a front elevation view of the rotor of the rotary switch deck shown in FIG. 2.
Figure 8:
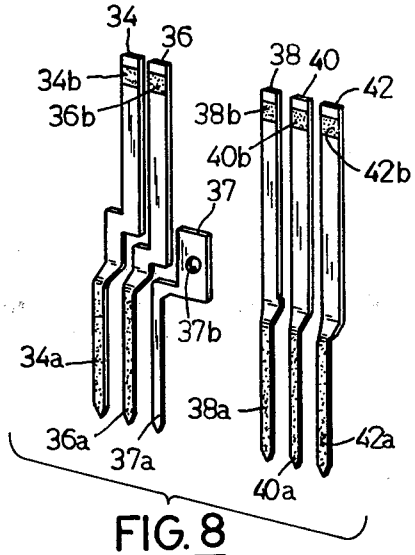
FIG. 8 is a perspective view of the rotary switch terminals shown in FIG. 2.
Figure 7:
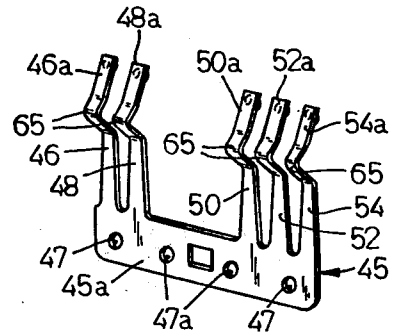
FIG. 7 is a perspective view of the rotary switch contact fingers shown in FIG. 2.
Figure 12:
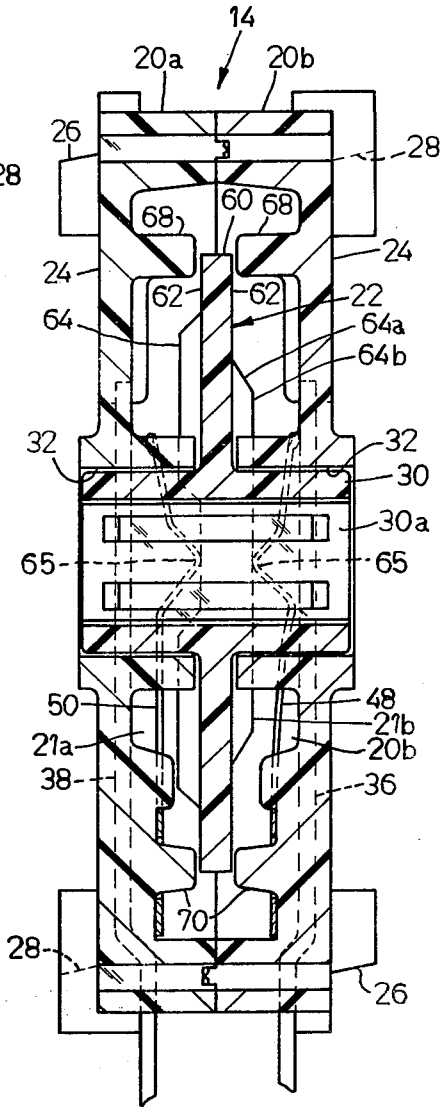
FIG. 12 is a cross-section view taken generally along line 12—12 in FIG. 9 and showing a pair of housings and a rotor therein forming a rotary switch deck.

As shown in FIG. 2, the rotor 22 includes a central axial shaft 30 receivable within cylindrical bores 32 defined by collars 33 located centrally in each of the housings 20*a* and 20*b*, whereby the rotor 22 is supported for rotation about an axis A by the housings 20*a* and 20*b*. As shown more clearly in FIGS. 3–5, the axial shaft 30 of the rotor includes a central axially extending rectangular slot 30*a* therethrough for receiving a complementary rectangular insert 30*b* whereby the rotor can be coupled for rotation with the central shaft of the indexing unit 12 and can be axially joined for rotation with an adjacent rotor 22 when the rotary switch decks 14 are stacked.

Figure 11:
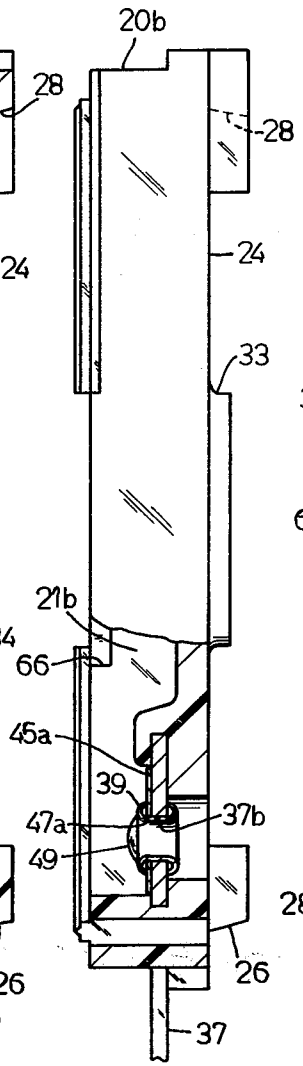
FIG. 11 is a cross-section view taken generally along line 11—11 shown in FIG. 9.
Figure 10:
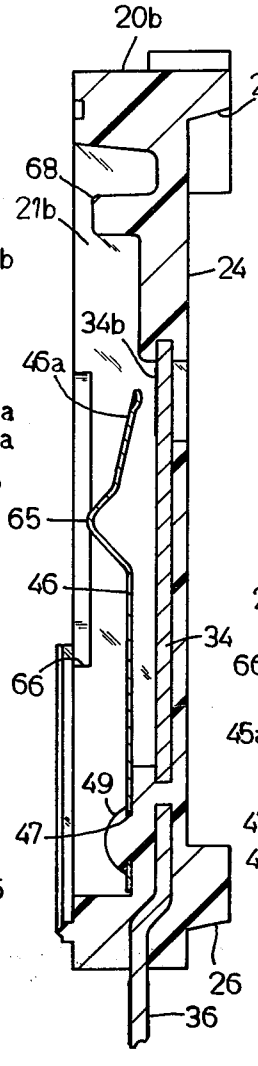
FIG. 10 is a cross-section view taken along line 10—10 in FIG. 9.
Figure 9:
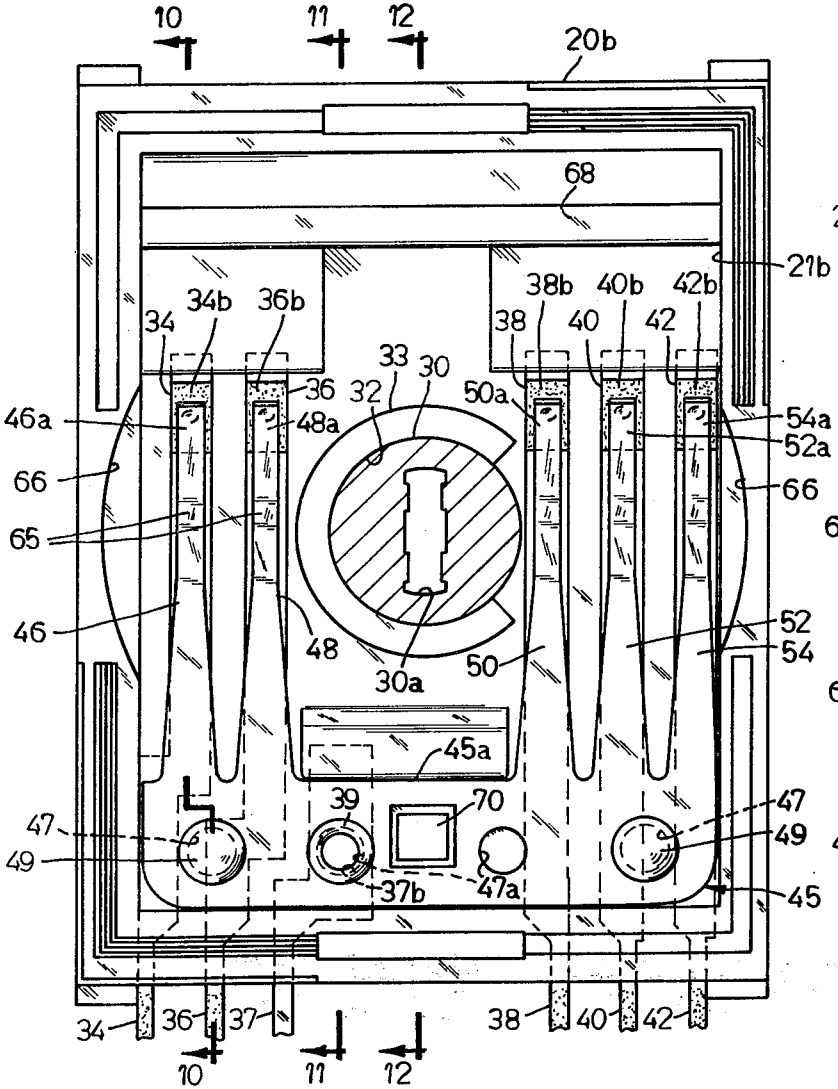
FIG. 9 is a front elevation view of one of the rotary switch housings of the rotary switch deck shown in FIG. 2.
Figure 13:
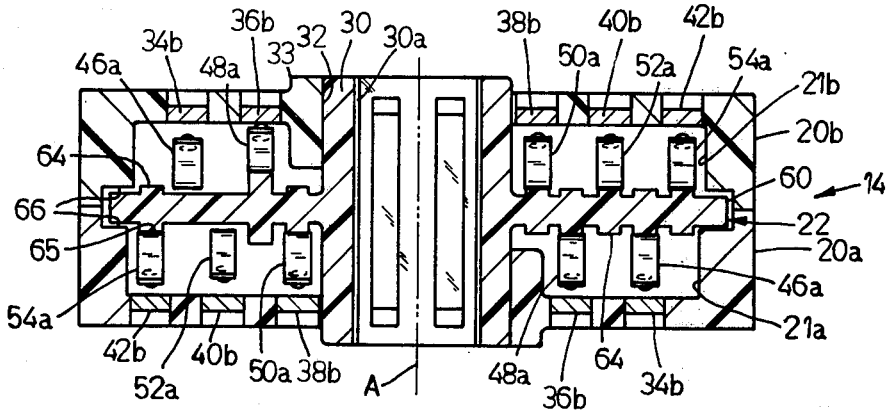
FIG. 13 is a modified section of a rotary switch deck and taken generally along line 13—13 in FIG. 14.
Figure 14:
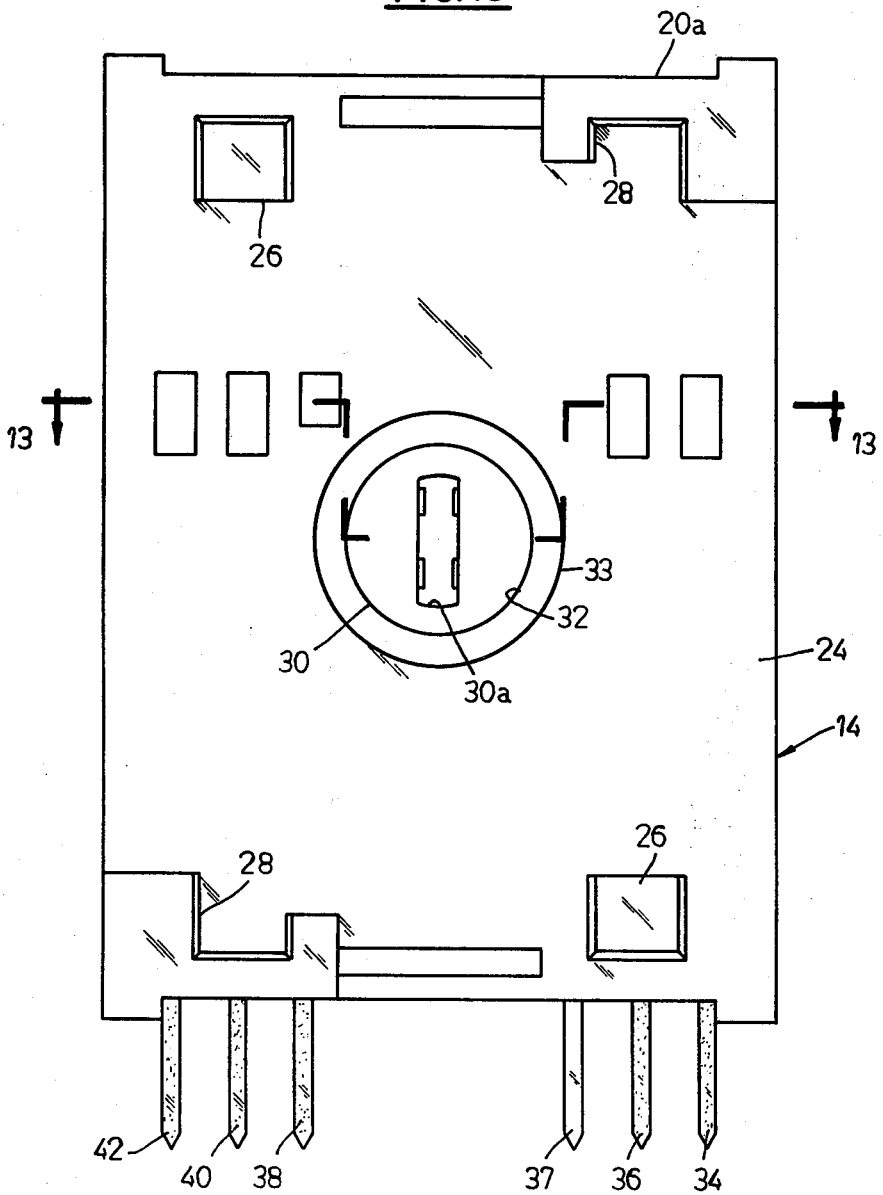
FIG. 14 is a front elevation view of the rotary switch deck shown in FIG. 2.

The housings 20*a* and 20*b* each support a plurality of electrical terminals 34, 36, 37, 38, 40 and 42 embedded in the molded housing and a one piece contact assembly 45, located within the housing cavity and having a plurality of electrically connected spring contact fingers 46, 48, 50 52 and 54 shown in FIGS. 2 and 7–9. The electrical terminals 34, 36, 37, 38, 40 and 42 are embedded in the molded housing in mutually spaced apart side-by-side relation, are electrically insulated from one another, and each have a terminal end 34*a*, 36*a*, 37*a*, 38*a*, 40*a* and 42*a*, respectively, projecting downwardly from the bottom of the housing whereby the terminals 34, 36, 38, 40 and 42 (FIG. 2) can each be connected to an integrated circuit 41 and whereby the common terminal 37 can be connected to voltage source 90. It will be appreciated by those skilled in the art that the terminal ends are positioned to permit the rotary switch assembly to plug into a circuit board or the like. The electrical terminals 34, 36, 38, 40 and 42 also include exposed generally coplanar and horizontally aligned precious metal terminal pads 34*b*, 36*b*, 38*b*, 40*b* and 42*b*, respectively, for making electrical contact with the contact fingers 46, 48, 50, 52 and 54 in a manner to be described. As shown in FIG. 10, the spring contact fingers 46–54 are mutually supported in generally planar alignment and are spaced apart from the terminals 34–42 in a direction parallel to the axis of rotor 22 but are closely adjacent to the terminals such that the respective free ends 46*a*–54*a* of the contact fingers 46–54 can be forced into electrical contact with the terminal pads 34*b*–42*b*. The contact fingers 46–54 are joined at their lower ends by a connecting base portion 45*a* (FIG. 7) which includes a plurality of bores 47 therethrough such that the contact fingers can be attached to the housing 20*b* by projecting integral plastic rivets 49 (FIG. 10). The electrical terminals 34–42 are shown as including a common terminal 37 to be connected to the voltage source 90 and truncated such that it does not include a terminal pad. The common terminal 37 is spaced apart from the other terminals and is electrically connected to the contact assembly 45 by a rivet 39 which extends through holes 37*b* in common terminal 37 and hole 47*a* in contact assembly 45, as best shown in FIG. 11. Alternatively, the contact assembly 45 could be provided with an intergral downwardly projecting terminal end and the common terminal 37 and rivet 39 deleted.

The rotor 22 is generally comprised of the axial shaft 30 supporting a circular disc 60, the circular disc having opposed parallel planar faces or surfaces 62 each supporting a plurality of raised arcuated cam lobes 64, the cam lobes 64 being circumferentially and concentrically spaced apart around said planar faces. The axis of the rotor 22 is generally perpendicular to the planes generally defined by the contact fingers and the electrical terminals such that the planar faces 62 are parallel to these planes. When the rotor 22 is supported between the housings 20*a* and 20*b* with the shaft 30 received in bores 32 of the housing, the disc 60 is prevented from misalignment by projecting nodes 66, 68 and 70 which each include a bearing surface intended to be received adjacent the planar surface 62 of the disc 60. As best shown in FIGS. 3–6, the arcuate cam lobes 64 each include ramp portions 64*a* at their opposite ends and a planar portion 64*b* intermediate the ramp portions. The cam lobes 64 are concentrically arranged such that the cam lobes are positioned in opposed relationship to the spring contact fingers 46–54, respectively.

Like the housings 20*a* and 20*b* in the preferred form, the rotor 22 is constructed from injection molded plastic comprising an integral one piece configuration. As an alternative embodiment, the rotor could be constructed such that the cams 64 could be individually attached in the desired pattern.

In operation, the common terminal 37 is intended to be connected to a voltage supply 90 of a circuit. Rotation of the rotor 22 will result in contact of a desired cam lobe 64 with the projecting elbow 65 of one of the spring contact fingers thereby biasing the free end of that contact finger into engagement with the terminal pad of the opposed terminal thereby closing a circuit.

It will be apparent that the arrangement or pattern of the arcuate cam lobes 64 and the face of the rotor 22 are intended to be dependent on the switching sequence desired. Alteration of the arrangement and position of the cam lobes 64 would permit variation of the sequence of contact of the contact fingers with the terminal pads or simultaneous engagement of a plurality of contact fingers with the respective opposed terminal pads. Furthermore, the number of contact fingers and terminals provided can be varied depending on the various switching sequence and mode of intended operation of the rotary switch desired.

The cam lobes should be raised sufficiently from the surface of the disc such that the spring contact fingers are biased against the terminal contact pads and further moved toward the terminal such that the end of the spring contact slides downwardly with respect to the terminal pad providing a wiping action and thereby ensuring good electrical contact between the terminal pad and the contact finger and maintaining low and stable contact resistance during closure and maintaining the mechanical life of the switch.

We claim:

1. A rotary switch assembly of a plurality of components comprising:

an indexing unit, said unit including a housing supporting therein a movable member rotatable to and between a plurality of indexed positions;

shaft means having opposite ends journaled in opposed walls of said unit housing and operatively engaging said movable member;

knob means adjacent the exterior face of a first of said unit housing end walls and engaging an end of one of said unit shaft ends for rotating said movable member to selected indexed positions;

supporting and stacking means for engaging complementing supporting and stacking means on an adjacent switch assembly component formed on the external face of the other of the unit housing end walls;

at least one rotary switch deck, said switch deck including housing means having side and end walls defining a cavity, each of said deck housing end walls including supporting and stacking means for engaging complementary supporting and stacking means on an adjacent switch assembly component;

a plurality of spaced apart fixed electrically conductive terminals having first extremities extending externally of one of said switch deck housing side walls and having second extremities secured within the deck housing cavity;

a plurality of flexible contact fingers supported by said deck housing within said cavity in a spatially separated relationship to the secured extremities of said electrically conductive terminals, said contact fingers having follower means;

means electrically interconnecting said contact fingers to at least one of said conductive terminals;

aligned journal means in said deck housing end walls;

a rotatable disc including a supporting shaft having opposite ends, said shaft ends being journaled in said deck housing journal means, said disc having planar surfaces normal to the axis of its supporting shaft with the disc positioned adjacent to said contact fingers;

means on said disc for engaging said contact finger follower means to move selected contact fingers into and out of contact with oppositely positioned conductive terminals responsive to rotation of said disc;

means for rotatably interconnecting opposite switch assembly component shaft ends whereby rotation of the indexing unit knob means to an indexed position results in a concomitant rotation and selective positioning of said disc.

2. The rotary switch assembly set forth in claim 1 wherein the switch deck housing comprises complementary identical frames, each of said frames providing portions of said side walls and one of said end walls and a portion of said aligned journal means, each of said frames having a complementary side wall supporting a plurality of said conductive terminals having their first extremities extending externally of said complementary side wall and their second extremities secured within the opening defined by said frame and supporting a plurality of said flexible contacting fingers in said opening in a spatially separated relationship to the secured extremities of said conductive terminals.

3. The rotary switch assembly set forth in claim 2 wherein the means on said disc for engaging said contact fingers includes a plurality of cam members supported by said disc surface and said cam members comprise arcuate cam lobes, at least two of said cam lobes being radially spaced apart with respect to said axis.

4. The rotary switch assembly set forth in claim 3 wherein said rotatable disc includes a second planar surface, each of said planar surfaces supporting a plurality of spaced apart cam members, said rotatable disc shaft ends being journaled in said frame end wall aligned journal means whereby said rotatable disc is positioned intermediate the contact fingers and upon rotation of the indexing unit will cause selected cam members to engage said contact finger follower means and move selected contact fingers into or out of contact with oppositely positioned conductive terminals.

5. The rotary switch assembly of claim 4 wherein said cam members each includes ramp portions at its opposite ends and planar portion intermediate the ramp portions.

6. The rotary switch assembly of claim 1 wherein the assembly comprises a plurality of interconnected switch decks.

7. A rotary switch assembly as set forth in claim 1 wherein said switch deck comprises:

a pair of opposed frames positioned in back-to-back relation;

a plurality of mutually spaced apart electrically conductive terminals supported by each of said frames;

a pair of contact means, one of said contact means supported by one of said frames and the other of said contact means supported by the other of said pair of frames, each of said contact means including a plurality of contact fingers, and means for providing electrical connection between said fingers, said contact fingers resiliently supported in spaced apart adjacent relationship to said electrically conductive terminals;

said rotatable disc supported between said frames and rotatable about a central axis, said disc having opposed parallel surfaces each defining a plane transverse to said axis and having a plurality of cam members supported by said surface for selectively contacting said contact fingers upon rotation of said disc and for forcing said contact fingers into engagement with said electrically conductive terminals; and said frame including a portion of said aligned journal means for supporting said rotatable disc for rotation about an axis transverse to said surface.

* * * * *